US007530471B2

(12) United States Patent
Cohen et al.

(10) Patent No.: US 7,530,471 B2
(45) Date of Patent: May 12, 2009

(54) DISPENSER HAVING DUAL DISPENSING MODES

(75) Inventors: Jason C. Cohen, Appleton, WI (US); Robert S. Schlaupitz, New London, WI (US); Eric D. Johnson, Larsen, WI (US); Steve R. Kehn, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 47 days.

(21) Appl. No.: 11/639,677

(22) Filed: Dec. 14, 2006

(65) Prior Publication Data

US 2008/0142536 A1 Jun. 19, 2008

(51) Int. Cl.
*A47K 10/24* (2006.01)
*B65H 1/00* (2006.01)

(52) U.S. Cl. ..... 221/48; 221/55; 221/53; 221/44

(58) Field of Classification Search ..... 221/48, 221/55, 47, 52, 63, 5, 2, 60; 220/254, 326, 220/829, 835, 8
See application file for complete search history.

(56) References Cited

U.S. PATENT DOCUMENTS 3,207,360 A * 9/1965 Scott ..... 221/48
3,499,575 A 3/1970 Rockefeller
3,843,017 A 10/1974 Harrison
3,881,632 A 5/1975 Early et al.
4,166,551 A 9/1979 Stiros
4,638,921 A * 1/1987 Sigl et al. ..... 221/1
4,699,371 A 10/1987 Ettischer et al.
4,741,944 A 5/1988 Jackson et al.
4,768,679 A * 9/1988 Matsui ..... 221/48
4,775,582 A 10/1988 Abba et al.
4,971,220 A 11/1990 Kaufman et al.
5,100,020 A 3/1992 Petterson et al.
5,219,092 A * 6/1993 Morand ..... 221/53

(Continued)

FOREIGN PATENT DOCUMENTS

EP 0 506 244 A1 9/1992

(Continued)

OTHER PUBLICATIONS

American Society for Testing Materials (ASTM) Designation: B 395-95, "Standard Specification for U-Bend Seamless Copper and Copper Alloy Heat Exchanger and Condenser Tubes," pp. 535-543, published Oct. 1995.

(Continued)

*Primary Examiner*—Gene Crawford
*Assistant Examiner*—Rakesh Kumar
(74) *Attorney, Agent, or Firm*—R. Joseph Foster, III; Scott A. Baum

(57) ABSTRACT

A wet wipes dispenser including a top having a dispensing orifice, a bottom, and a sidewall. At least one lid for retaining moisture in the wet wipes dispenser and for access to a stack of wet wipes located inside of the wet wipes dispenser. At least one restraining member positioned inside of the wet wipes dispenser to hold the stack of wet wipes within the wet wipes dispenser elevated at a distance, H, from the dispensing orifice when the wet wipes dispenser is inverted.

16 Claims, 10 Drawing Sheets

U.S. PATENT DOCUMENTS

| | | | | |
|---|---|---|---|---|
| 5,363,985 | A | 11/1994 | Cornell | |
| 5,540,332 | A | 7/1996 | Kopacz et al. | |
| 5,785,179 | A | 7/1998 | Buczwinski et al. | |
| 5,957,325 | A | 9/1999 | Montanez | |
| 6,003,723 | A * | 12/1999 | Morand | 221/44 |
| 6,028,018 | A | 2/2000 | Amundson et al. | |
| 6,202,889 | B1 | 3/2001 | Veith | |
| 6,206,221 | B1 * | 3/2001 | Bando et al. | 220/254.5 |
| 6,269,969 | B1 | 8/2001 | Huang et al. | |
| 6,269,970 | B1 * | 8/2001 | Huang et al. | 220/836 |
| 6,299,017 | B1 * | 10/2001 | Hill | 221/63 |
| 6,315,114 | B1 | 11/2001 | Keck et al. | |
| 6,338,855 | B1 | 1/2002 | Albacarys et al. | |
| 6,349,525 | B1 | 2/2002 | Veith | |
| 6,401,968 | B1 | 6/2002 | Huang et al. | |
| 6,523,690 | B1 | 2/2003 | Buck et al. | |
| 6,592,004 | B2 | 7/2003 | Huang et al. | |
| 6,613,729 | B1 | 9/2003 | Cole et al. | |
| 6,673,358 | B1 | 1/2004 | Cole et al. | |
| 6,752,290 | B2 | 6/2004 | Tramontina | |
| 6,766,919 | B2 | 7/2004 | Huang et al. | |
| 6,848,595 | B2 | 2/2005 | Lange et al. | |
| 6,892,898 | B1 | 5/2005 | Boone et al. | |
| 6,905,748 | B2 | 6/2005 | Sosalla | |
| 6,946,413 | B2 | 9/2005 | Lange et al. | |
| 6,994,863 | B2 | 2/2006 | Eini et al. | |
| 6,994,865 | B2 | 2/2006 | Branham et al. | |
| 7,073,684 | B2 | 7/2006 | Decker et al. | |
| 7,101,456 | B2 | 9/2006 | Bunyard et al. | |
| 7,101,612 | B2 | 9/2006 | Lang et al. | |
| 2003/0221986 | A1 * | 12/2003 | Reinke et al. | 206/494 |
| 2004/0124101 | A1 * | 7/2004 | Mitchell et al. | 206/205 |
| 2005/0092764 | A1 * | 5/2005 | Chasid et al. | 221/63 |
| 2005/0092765 | A1 * | 5/2005 | Chasid et al. | 221/63 |
| 2005/0194395 | A1 | 9/2005 | Julius | |
| 2005/0211717 | A1 | 9/2005 | Decker et al. | |
| 2005/0211718 | A1 | 9/2005 | Decker et al. | |

FOREIGN PATENT DOCUMENTS

| | | | |
|---|---|---|---|
| EP | 0 858 958 | A2 | 8/1998 |
| GB | 24331 | A | 0/1913 |
| GB | 1 186 787 | A | 4/1970 |
| WO | WO 02/45762 | A2 | 6/2002 |
| WO | WO 2004/054898 | A1 | 7/2004 |
| WO | WO 2004/093629 | A1 | 11/2004 |

OTHER PUBLICATIONS

American Society for Testing Materials (ASTM) Designation: D 412-98a, "Standard Test Methods for Vulcanized Rubber and Thermoplastic Elastomers—Tension," pp. 43-55, published Aug. 1998.

American Society for Testing Materials (ASTM) Designation: D 792-98, "Standard Test Methods for Density and Specific Gravity (Relative Density) of Plastics by Displacement," pp. 159-163, published Nov. 1998.

American Society for Testing Materials (ASTM) Designation: D2240-97, "Standard Test Method for Rubber Property—Durometer Hardness," pp. 400-403, published Mar. 1997.

American Society for Testing Materials (ASTM) Designation: D6125-97, "Standard Test Method for Bending Resistance of Paper and Paperboard (Gurley Type Tester)," pp. 885-889, published Feb. 1998.

* cited by examiner

DISPENSER HAVING DUAL DISPENSING MODES

BACKGROUND

Dispensers for wet wipes products such as baby wet wipes, perineal wet wipes, and surface or household cleaning wet wipes are generally designed to be placed onto a horizontal counter or surface located beneath the dispenser. Typically, a dispensing orifice is located in the top of the dispenser beneath a lid, cover, or closure member that retains the moisture of the wet wipes when not in use. Such dispensers are convenient, but there is a desire to free up cluttered counter space by relocating the wet wipes dispenser to an inverted position underneath a cabinet or cupboard. However, not all consumers of wet wipes would want to use an inverted wet wipes dispenser. Some would prefer to continue placing the wet wipes dispenser onto a counter for use.

Inverted dispensers for dry paper napkins or paper towels having a vertical stack of folded or interfolded sheets housed in the dispenser and which dispense from the bottom of the dispenser through a dispensing orifice are known. Inverted paper towel dispensers are frequently used in the public restrooms of commercial facilities. Inverted paper towel dispensers are not readily usable for dispensing wet wipes due to the unique characteristics of wet wipes. For example, a stack of wet wipes having a given size weighs much more than the same size stack of dry paper towels from the weight of the water contained by the wet wipes stack. The methods and structural elements used to keep the dry paper towel stack within the inverted dispenser often apply too much drag force when a wet stack is placed into the inverted dispenser. This can lead to tearing and ripping of the wet wipes when attempting to dispense the first few sheets from the stack. Inverted paper towel dispensers are not designed to retain moisture within the stack of sheets placed into the dispenser. Additionally, inverted paper towel dispensers are not designed for placement onto a counter in a non-inverted dispensing mode; generally, they are hung from a vertical wall.

Therefore, a need exists for an inverted wet wipes dispenser that reliably dispenses wet wipes. A need also exists for a wet wipes dispenser having dual dispensing modes that can be supported on a counter in an upright position for one mode of dispensing or placed into an inverted position for a second mode of dispensing.

SUMMARY

The inventors have determined that by providing a wet wipes dispenser with at least one restraining member positioned inside of the wet wipes dispenser to hold the stack of wet wipes within the wet wipes dispenser elevated at a distance, H, from the dispensing orifice when the wet wipes dispenser is inverted, the wet wipes dispenser can be used for upright or inverted dispensing as the user desires.

Hence, in one aspect, the wet wipes dispenser includes a top having a dispensing orifice, a bottom, and a sidewall; at least one lid covering the dispensing orifice for access to a stack of wet wipes having a pair of opposing sides and a pair of opposing ends located inside of the wet wipes dispenser; and at least one restraining member to hold the stack of wet wipes within the wet wipes dispenser elevated at a positive distance, H, from the dispensing orifice when the wet wipes dispenser is inverted.

BRIEF DESCRIPTION OF THE DRAWINGS

The above aspects and other features, aspects, and advantages of the present invention will become better understood with regard to the following description, appended claims, and accompanying drawings in which:

Figure 1:
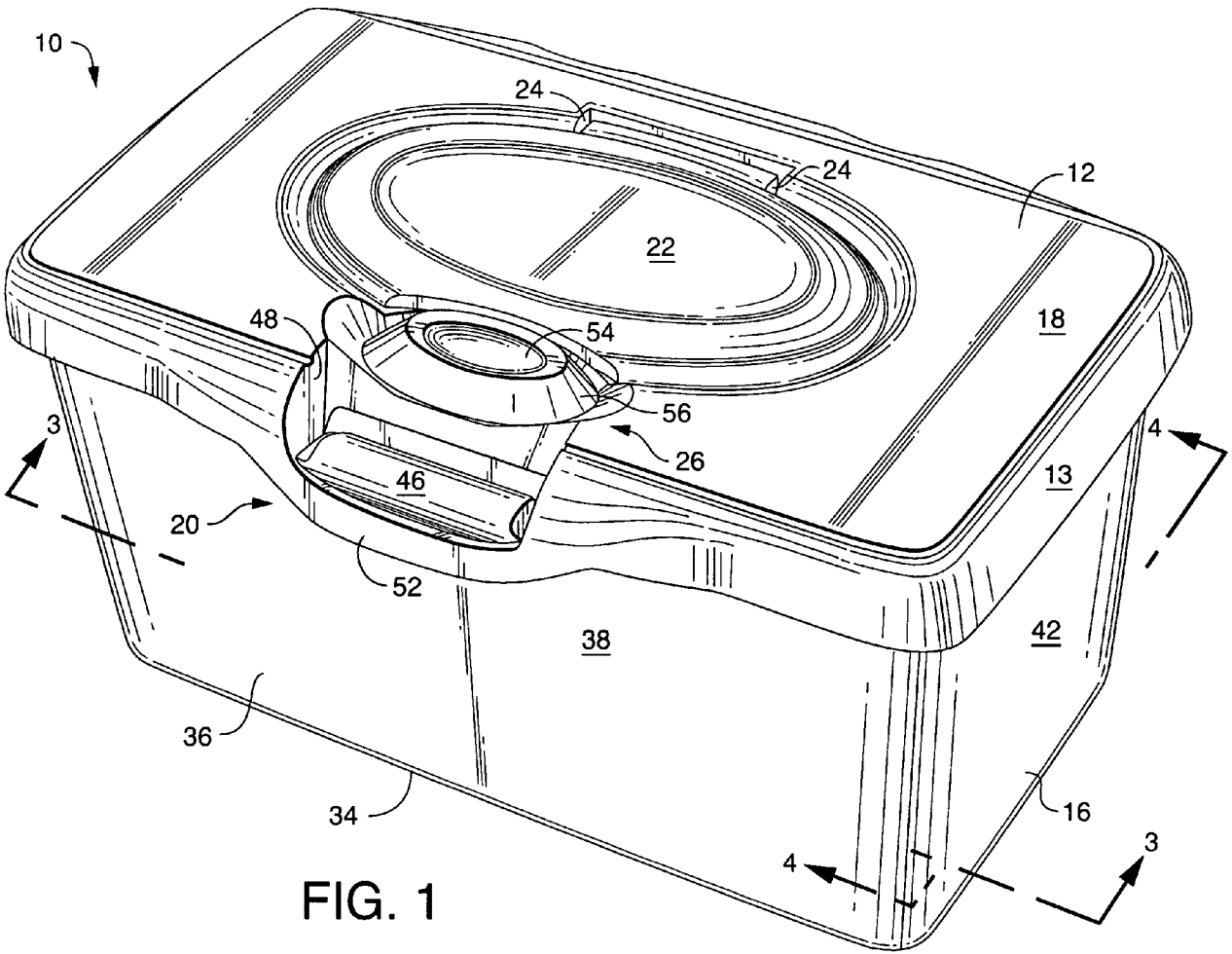
FIG. 1 is a perspective view illustrating one embodiment of a wet wipes dispenser.
Figure 2:
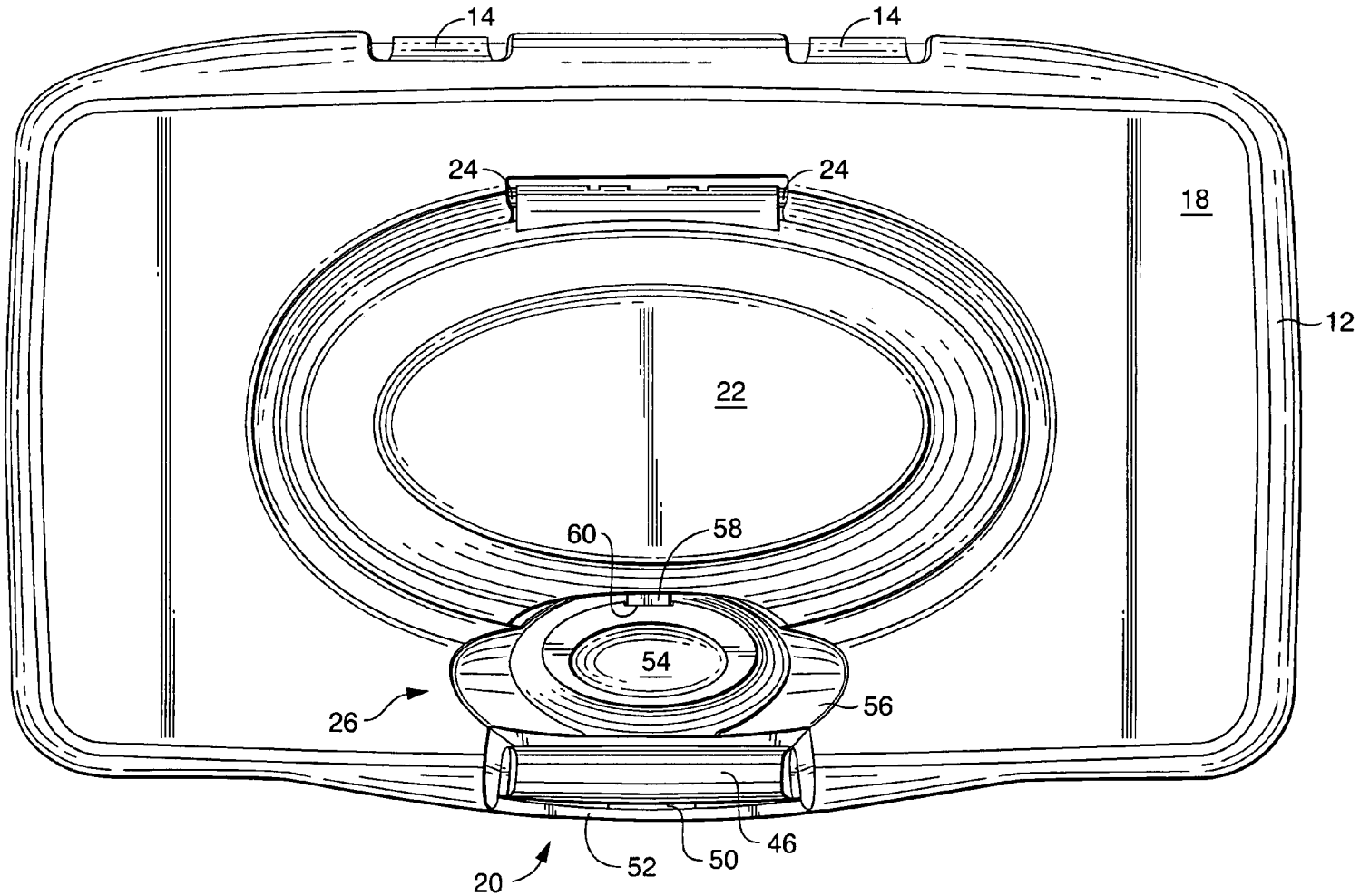
FIG. 2 is a plan view of the wet wipes dispenser of FIG. 1.

Repeated use of reference characters in the specification and drawings is intended to represent the same or analogous features or elements of the invention in different embodiments.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Referring now to FIGS. 1, 2, 3, 4, 5, and 7, a wet wipes dispenser 10 is illustrated. The wet wipes dispenser includes a top 12 having a skirt 13 that is attached by a pair of hinges 14 to a tub 16. The top 12 includes a main lid 18 which can be opened by a first latch 20 to gain access to the interior of the tub 16. The top 12 includes a mini-lid 22 or dispensing lid that is attached to the main-lid 18 or refill lid by a pair of posts 24 located along the rear edge which fit into an opposing pair of holes 25 located in the main-lid 18. The posts 24 and holes 25 form hinges allowing for rotation of the mini-lid 22 away from the top surface of the main-lid 18. A mini-lid latch 26 allows the mini-lid 22 to be opened for access to a dispensing orifice 28 for dispensing a plurality of wet wipes 30 folded and assembled into a stack 32 located within the wet wipes dispenser.

Suitable wet wipes 30 or wet wipes assembled into a stack 32 for use with the wet wipes dispenser 10 are disclosed in U.S. Pat. No. 4,741,944 entitled Wet Wipe and Wipe Dispensing Arrangement; U.S. Pat. No. 5,540,332 entitled Wet Wipes Having Improved Dispensability; U.S. Pat. No. 6,028,018 entitled Wet Wipes With Improved Softness; U.S. Pat. No. 6,613,729 entitled Wet Wipes Containing Cationic Fatty Acid Surfactants; U.S. Pat. No. 6,673,358 entitled Wet Wipes Containing a Mono Alkyl Phosphate; U.S. Pat. No. 6,848,595 entitled Wipes With A Pleat-Like Zone Along The Leading Edge Portion; U.S. Pat. No. 6,905,748 entitled Stack Of Fan Folded Material And Combinations Thereof; U.S. Pat. No. 6,946,413 entitled Composite Material With Cloth-Like Feel; U.S. Pat. No. 6,994,865 entitled Ion Triggerable, Cationic Polymers, A Method Of Making Same And Items Using Same; U.S. Pat. No. 7,101,456 entitled Ion Triggerable, Cationic Polymers, A Method Of Making Same And Items Using Same; and in U.S. Pat. No. 7,101,612 entitled Pre-Moistened Wipe Product.

In general, the wet wipes 30 are formed from a suitable dispersible or non-dispersible substrate that is impregnated with a wetting formulation typically including at least one surfactant and water. The wetting formulation can contain many other ingredients such as humectants, emollients, additional surfactants, preservatives, and skin care active ingredients or other ingredients such as disclosed in U.S. Pat. No. 6,338,855 entitled Cleansing Articles For Skin Or Hair Which Also Deposit Skin Care Actives. The wet wipes 30 are saturated with the wetting formulation such that the wet wipes contain between about 50% to about 600% weight percent of the solution based on the dry weight of the substrate. The wet wipes 30 are then assembled into a stack 32 by fan folding, interfolding, multi-folding, or stacking. The wet wipes 30 in the stack 32 can be interrelated such that withdrawing one wet wipe partially withdraws the next wet wipe from the dispensing orifice 28, or the wet wipes can be assembled into the stack for reach-in dispensing.

The lower tub 16 includes a bottom 34 and a sidewall 36 forming a receptacle for the stack 32 of wet wipes 30. The sidewall 36 can include an opposing front panel 38 and back panel 40, and an opposing right panel 42 and left panel 44. The lower tub 16 has a generally rectangular shape; however, any other convenient shape can be used.

The first latch 20 in one embodiment was constructed in accordance with the latch described and disclosed in U.S. Pat. No. 5,785,179 by Buczwinski et al. entitled Container for Wet Wipes Having an Improved Closure Mechanism. The first latch 20 includes an elongated tongue projection 46 which is connected to and extends outwardly from the front panel 38 of the tub 16. A recess 48, which is located in a convex portion of the top's skirt 13, extends convexly outward. The recess 48 preferably has a length of at least about 2.5 centimeters and a depth of at least about 1.0 centimeters. An aperture 50 is located in the recess 48 that is adapted to engage the tongue projection 46 when the main-lid 18 is in a closed position. A resiliently flexible lip member 52 extends along a portion of an outer periphery of the aperture 50 and is configured to flex outwardly to direct the tongue projection 46 into the aperture 50 and snap into position under the tongue projection 46 when the main-lid 18 is closed. A shelf 53 attached to the lip member 52 and extending into the aperture 50 is provided to act as a catch beneath the tongue projection 46 holding the main-lid 18 in a closed position. An advantage of the first latch 20 constructed as described is that the main-lid 18 of the container can be opened by using only one hand. By placing a thumb on the tongue projection 46 and an index finger on the lip member 52, the tongue projection can be disengaged from the lip member and shelf 53 by flexing the lip member outward. After which, the main-lid 18 can be rotated about the hinges 14 by lifting the lip member 52 with the index finger and thumb to gain access to the interior of the wet wipes dispenser 10. If desired, the main-lid 18 can be provided with a biasing member such as a spring to either hold the main lid in an open position when unlatched or to hold the main-lid 18 in a closed position. Biasing of the main-lid 18 in a specific direction may be desirable for assisting with refilling the wet wipes dispenser when the wet wipes dispenser is inverted.

The mini-lid latch 26 can include a push button 54 with a portion of the button having an elastomeric wall 56. The elastomeric wall 56 can compress and deform when the push button 54 is depressed, disengaging a projection 58 extending from the front edge of the mini-lid 22 opposite the posts 24. The projection 58 fits into an indentation 60 located in the push button 54 to hold the mini-lid 22 in a closed position.

The wet wipes dispenser 10 can be co-molded from two different materials such as a hard plastic and a softer thermoplastic elastomeric (TPE) material. As such, sealing areas between the main-lid 18 and the tub 16, and/or between the mini-lid 22 and main-lid 18, can have a gasket formed by the TPE material, if desired, to enhance moisture retention of the wet wipes dispenser 10. The push button 54 can be co-molded with the elastomeric wall 56 of the push button formed from TPE material for easier use.

Figure 5:
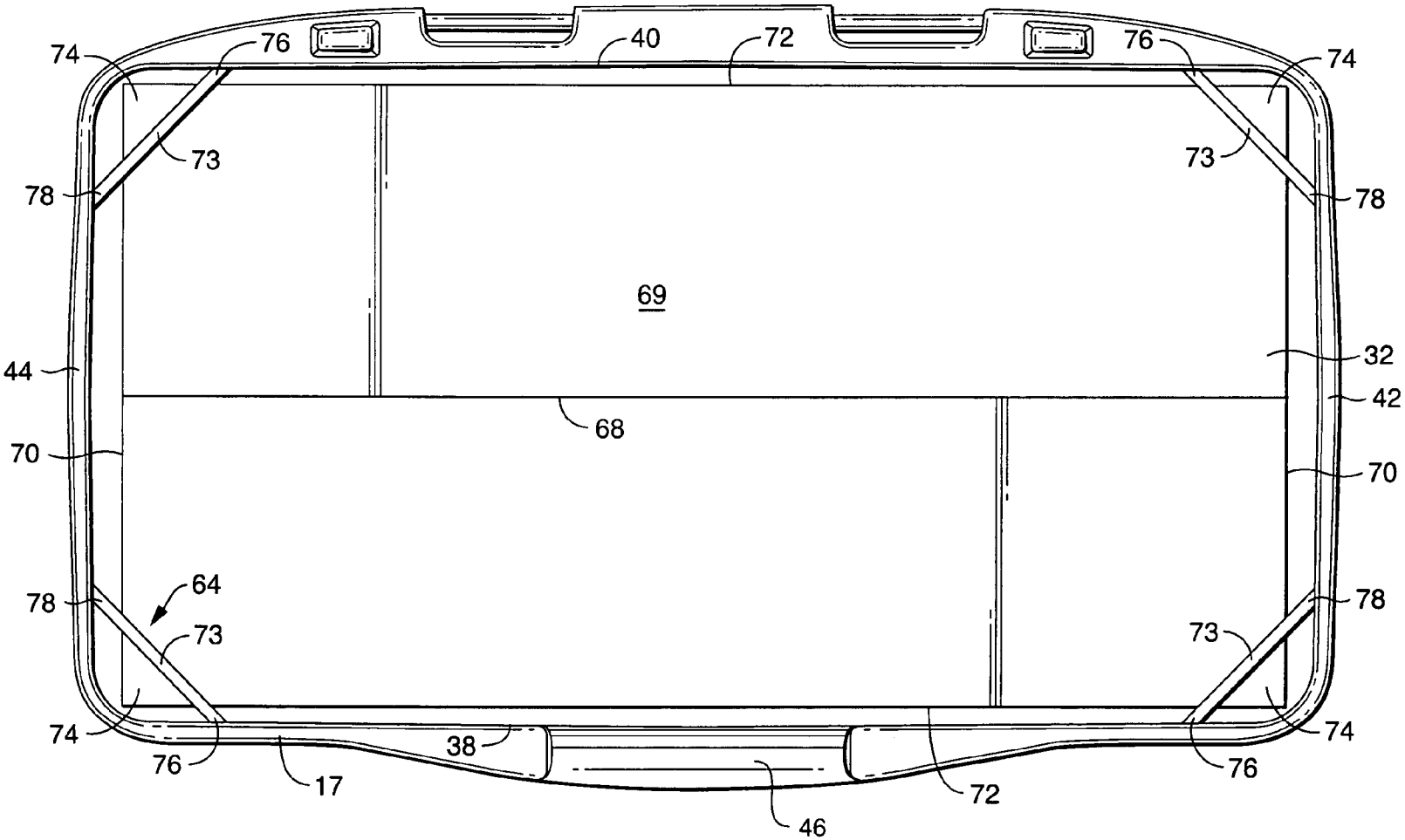
FIG. 5 is a plan view of the bottom tub of the wet wipes dispenser of FIG. 1 with the top of the dispenser removed.
Figure 7:
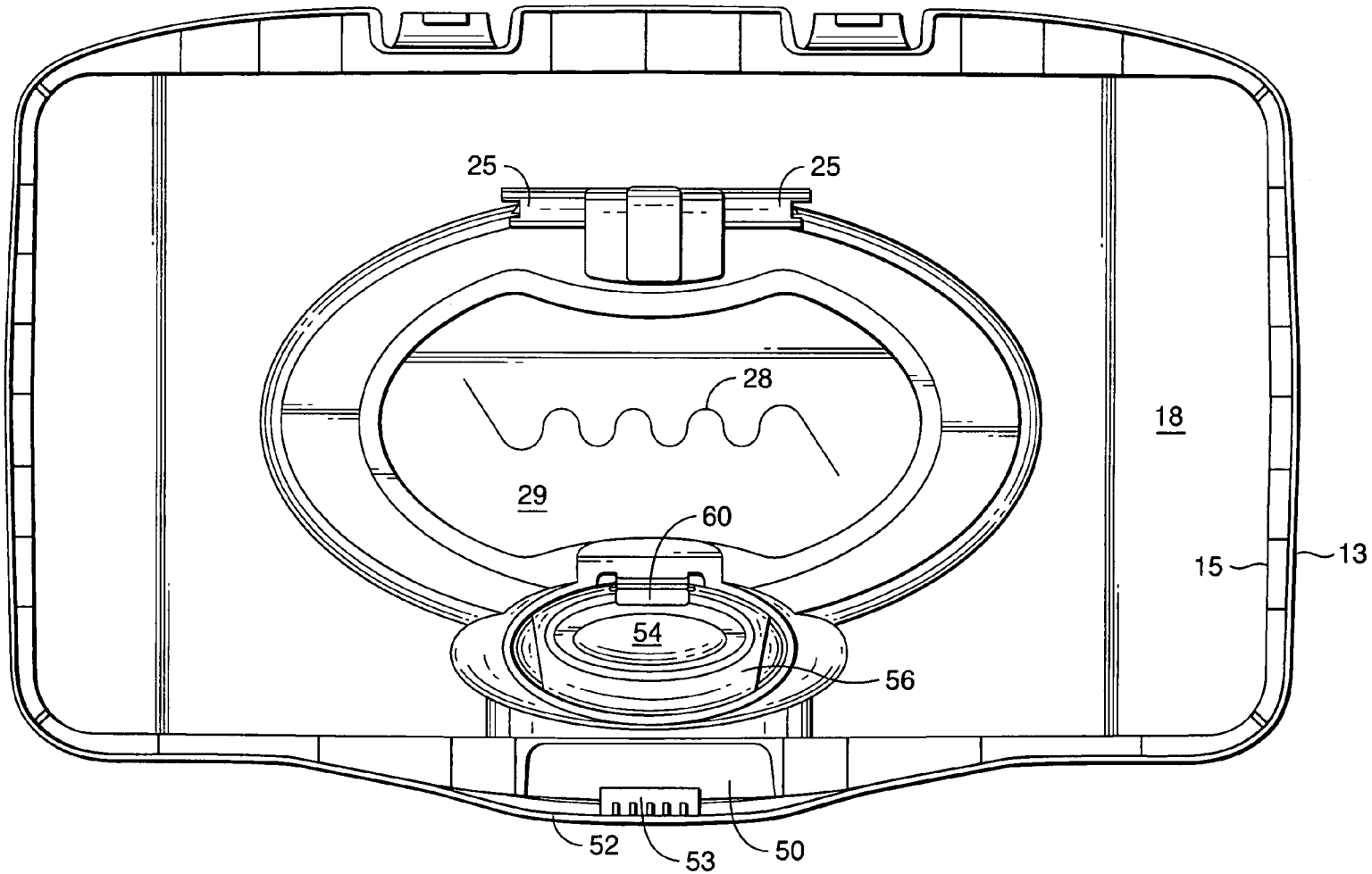
FIG. 7 is a plan view of the inside of the top of the dispenser of FIG. 1.

The dispensing orifice 28 can be formed as a slit in a dispensing panel 29 located beneath the mini-lid 22 that is formed from flexible or elastic material. The narrow slit in the dispensing panel 29 can help to retain moisture in the wet wipes dispenser 10, securely hold the exposed portion of the wet wipe in place, and make it easier to reach into the wet wipes dispenser to retrieve the next wipe should the pop-up functionality fail since the elastomeric or flexible material can be readily deformed and then resume its original shape. Furthermore, a narrow slit with a wet wipe protruding from the slit effectively plugs the dispensing orifice 28, reducing any possible leakage of the wetting solution from the wet wipes dispenser when the wet wipes dispenser is inverted. The dispensing orifice 28 can be a slit having a sinusoidal middle portion with two legs extending in opposing directions from the middle portion as illustrated in FIG. 7. Alternatively, the dispensing orifice 28 can be another size and/or shape such as circular, oval, rectangular, H shaped, + shaped, star shaped, or other suitable shape. Preferably, the dispensing orifice 28 is restricted or reduced in size as compared to a dispensing surface area 69 of the wet wipes stack 32, as shown in FIG. 5, in order to assist in separating successive wet wipes and to retain the wet wipes partially exposed from the dispensing orifice during upright dispensing.

Suitable materials for forming the dispensing panel 29 and different embodiments of the dispensing orifice are disclosed in U.S. Pat. No. 6,766,919 entitled Flexible Orifice For Wet Wipes Dispenser; in U.S. Pat. No. 6,592,004 entitled Flexible Orifice For Wet Wipes Dispenser; and in U.S. Pat. No. 6,523,690 entitled Wet Wipe Container With Flexible Orifice. The dispensing panel 29 can be a flexible rubber-like sheet, the relevant material properties can be described in terms of the hardness, stiffness, thickness, elasticity, specific gravity, compression set, and any combination thereof. More specifically, the Shore A hardness (as measured by ASTM D2240) of the flexible, rubber-like sheet or material can be about 100 or less, more specifically from about 20 to about 90, and still more specifically from about 40 to about 80, and yet more specifically from about 60 to about 70 Shore A. The Gurley stiffness of the flexible, rubber-like sheet or material (as measured by ASTM D 6125-97 "Standard Test Method for Bending Resistance of Paper and Paperboard") can be about 10,000 milligrams of force (mgf) or less, more specifically from about 100 to about 8000 mgf, more specifically from about 200 to about 6500 mgf, and still more specifically from about 300 to about 1500 mgf. The thickness of the flexible, rubber-like sheet can be about 10 mil or greater, more specifically from about 10 mil to about 110 mil, and still more specifically from about 35 mil to about 60 mil. The elasticity of the flexible rubber-like material or sheet, as characterized by the tensile stress at 100 percent elongation and measured in accordance with ASTM D412 "Standard Test Methods for Vulcanized Rubber and Thermoplastic Elastomers", can be about 10 megapascals (MPa) or less, more specifically from about 0.1 to about 7 MPa, and still more specifically from about 0.5 to about 2.5 MPa. The flexible rubber-like sheet can have a specific gravity (per ASTM D792) of about 0.80 to 1.21, more specifically 0.88 to about 1.10, and still more specifically from about 0.90 to about 1.0. The flexible rubber-like sheet can have a compression set (per ASTM 395B) of (at room temperature/at 70 degrees C.) about 8/30 to 40/120 and more specifically 15/45 to about 28/100.

Suitable dispensing panel materials include thermoplastic elastomeric materials. Materials which can be employed include (but are not limited to): any of the family of styrenic-based TPE's (i.e., styrenic block copolymer compounds); styrenic-based TPE's containing rubber modifiers such as Kraton®, Santoprene®, or other rubber modifiers; Kraton®; Santoprene®; specialty copolymers, such as ethylene-methyl acrylate copolymers (e.g., EMAC® of the Eastman Chemical Company); thermoset rubbers; polyurethane; alloys; amides; engineering TPE's; olefinic-based; olefinic vulcanizates; polyester-based; polyurethane-based. One such material for the flexible dispensing panel could be that manufactured by the GLS-Corporation of McHenry, Ill., USA and known as resin #G2701. The G2701 material is one of the resins in the product family of TPEs. G2701 is a styrenic-based material and is in the family of Styrenic block copolymer compounds. Some particular properties of the G2701 can be: specific gravity of 0.090 g/cc (per ASTM D792); hardness (Shore A durometer) of 68 (ASTM D2240); and compression set of 24% at room temperature, 96% at 70 deg. C. (per ASTM 395B). Another similar material is known as G2755 and also sold by GLS Corporation. In addition, a lubricant (e.g., wax) can be added to lower the coefficient of friction of the continuous slit which can benefit injection molding, wet wipes dispensing, and physical handling of the flexible orifice. The G2701 TPE resin with ¼% wax additive sold by GLS Corporation and known as #LC217-189 can be used.

The wet wipes dispenser 10 can be placed onto a counter or surface with the bottom 34 of the tub 12 supported by the surface for upright dispensing. To dispense a wet wipe 30 from the stack 32 of wet wipes inside the dispenser, the push button 54 is depressed and a biasing member such as an elastomeric or metal spring positioned between the mini-lid 22 and the main-lid 18 rotates the mini-lid to an open position, revealing a wet wipe partially exposed from the dispensing orifice 28 for retrieval. After retrieval, the mini-lid 22 can be pushed towards the main-lid 18 and latched by the mini-lid latch 26 into a closed position until another wet wipe is needed. Desirably, the sheets forming the wet wipes are perforated together, interfolded together, multi-folded, adhesively attached, or interrelated such that withdrawing one wet wipe partially withdraws a portion of the next wet wipe.

Figure 6:
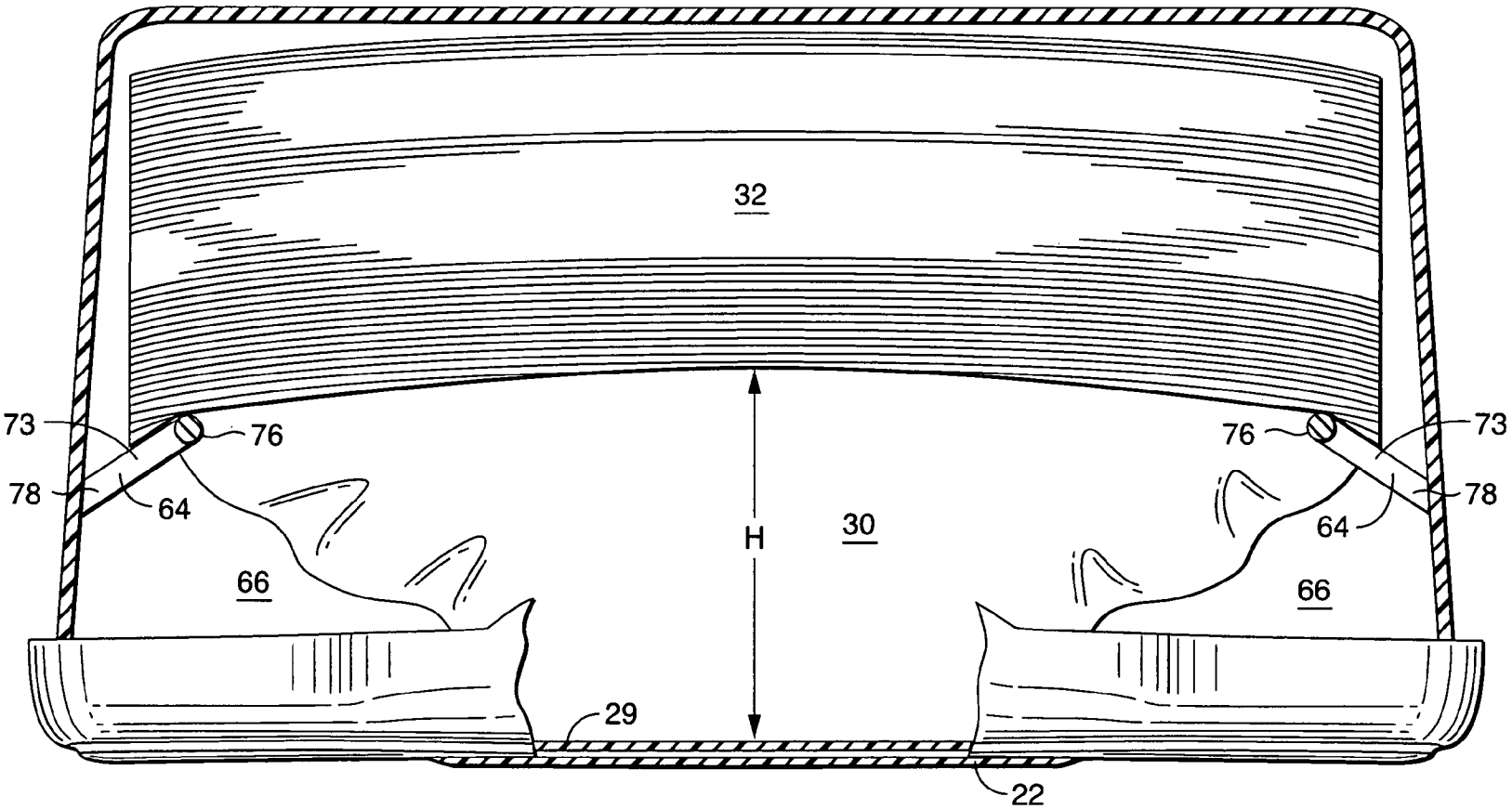
FIG. 6 is a partially cut away front view of the wet wipes dispenser of FIG. 1 taken at 3-3 just inside of the front sidewall of the lower tub with the wet wipes dispenser inverted.

Referring now to FIGS. 3, 4, 5, and 6, the wet wipes dispenser 10 includes at least one restraining member 64, and desirably at least two or at least four restraining members that engage with the stack 32 and keep the stack elevated at a height, H, from the interior surface of the top 12 such as the dispensing panel 29 with dispensing orifice 28 and/or the main-lid 18 when the wet wipes dispenser 10 is inverted, as best seen in FIG. 6. The restraining members 64 allow for the wet wipes dispenser 10 to be used in an inverted dispensing mode and do not interfere with sheet dispensing when the wet wipes dispenser 10 is used in an upright dispensing mode. By allowing for the use of the wet wipes dispenser 10 in either the inverted mode or the upright mode, consumers have a choice in how the wet wipes dispenser is orientated to suit their personal preference. Additionally, by having an inverted dispensing mode, the wet wipes dispenser 10 will dispense moister wet wipes. With especially tall stacks, the liquid in the wet wipes 30 can accumulate in the tub's bottom 34 due to gravity during upright dispensing leaving the wet wipes near the top drier. By inverting the wet wipes dispenser 10, the liquid will accumulate in the sheets adjacent to the dispensing orifice 28, thereby preventing the next sheet to be dispensed from being too dry. This allows consumers to control the relative moisture level of the wet wipes by inverting the wet wipers dispenser 10 as desired.

The inventors have determined that it is desirable to have at least a portion of the wet wipes stack 32 elevated and not resting on an interior surface of the top 12 such as the dispensing panel 29 with the dispensing orifice 28 or the main-lid 18 when the wet wipes dispenser 10 is inverted for upside down dispensing. This provides a volume 66 for the wet wipe 30 currently being dispensed to transition within as it undergoes change from a relatively flat state while residing in the stack 32 to a contracted gathered state as it moves through the dispensing orifice 28. It is desirable to at least elevate the middle portion of the stack 32 near the dispensing orifice 28 to provide the volume 66. It may not be necessary to elevate the opposing ends 70 of the stack 32; especially, if the stack is concave shaped as discussed herein later. Elevating the stack 32 is particularly important for higher sheet count stacks ranging in count from about eight or more wet wipes where the weight of a full stack resting on an interior surface of the top 12, such as the dispensing panel 29 with dispensing orifice 28 or main-lid 18, can make it impossible to withdraw the next wet wipe from the inverted dispenser 10 without tearing the wet wipe as it is dispensed.

In various embodiments of the invention, at least a portion of the stack 32 is elevated a positive distance, H, such as 0.1 inch or greater, to provide a volume as discussed above. Desirably, the middle of the stack 32 is elevated a positive distance, H, at least from the dispensing orifice 28. Alternatively, the stack 32 is elevated a positive distance, H, from the interior surfaces of the top 12, such as the dispensing panel 29 or the main-lid 18. In various embodiments of the invention, the height, H, can be between approximately 0.5 inches to about 2 inches, or between about 0.75 inches to about 1.5 inches, or between about 1.0 inches to about 1.25 inches. Having too little height can cause dispensing problems by having insufficient volume for the wet wipe to unfurl as it is dispensed leading to tears. Having too much height can undesirably reduce the sheet count capacity of the wet wipes dispenser and/or make the dispenser too large.

Another factor that has an affect on reliable inverted dispensing is the total area of the stack 32 in contact with the restraining members 64. Referring to FIG. 5, the stack 32 includes a leading edge 68 of the first wet wipe 30, a first pair of opposing ends 70, and a second pair of opposing sides 72.

In one embodiment, the stack 32 can be formed from a series of perforated sheets that are fan-folded such that each of the second pair of opposing sides 72 includes a plurality of folded edges of the wet wipes within the stack 32 as disclosed in U.S. Pat. No. 6,905,748. Each of the first pair of opposing ends 70 includes a plurality of individual sheet edges of the wet wipes. The stack 32 has a dispensing surface area 69 of the wet wipes in the stack prior to being pulled off of the stack towards the dispensing orifice 28 that is the length of the stack along the opposing sides 72 multiplied by the width of the stack along the opposing ends 70.

The inventors have determined that using four restraining members 64 that contact along the entire width of both of the stack's ends 70 and along the entire length of both of the stack's sides 72 can provide too much contact area for reliable inverted dispensing of the wet wipes depending on far the restraining members extend across the dispensing surface area 69 of the wet wipes stack 32. To improve inverted wet wipes dispensing, the dispensing surface area 69 of the stack 32 in contact with the restraining members 64 should be reduced to lessen the drag forces as the wet wipe is dispensed; especially when the stack 32 is full or almost full and the dispenser is inverted. The drag force of a wet wipe as it is dispensed can be significantly greater than the drag force of a dry paper towel since the damp wipe will often stick or adhere to surfaces it comes into contact with. Alternatively stated, the total area of the restraining members 64 contacting the dispensing surface area 69 should be reduced to improve inverted dispensing while keeping the stack 32 elevated at a height, H.

Figure 3:
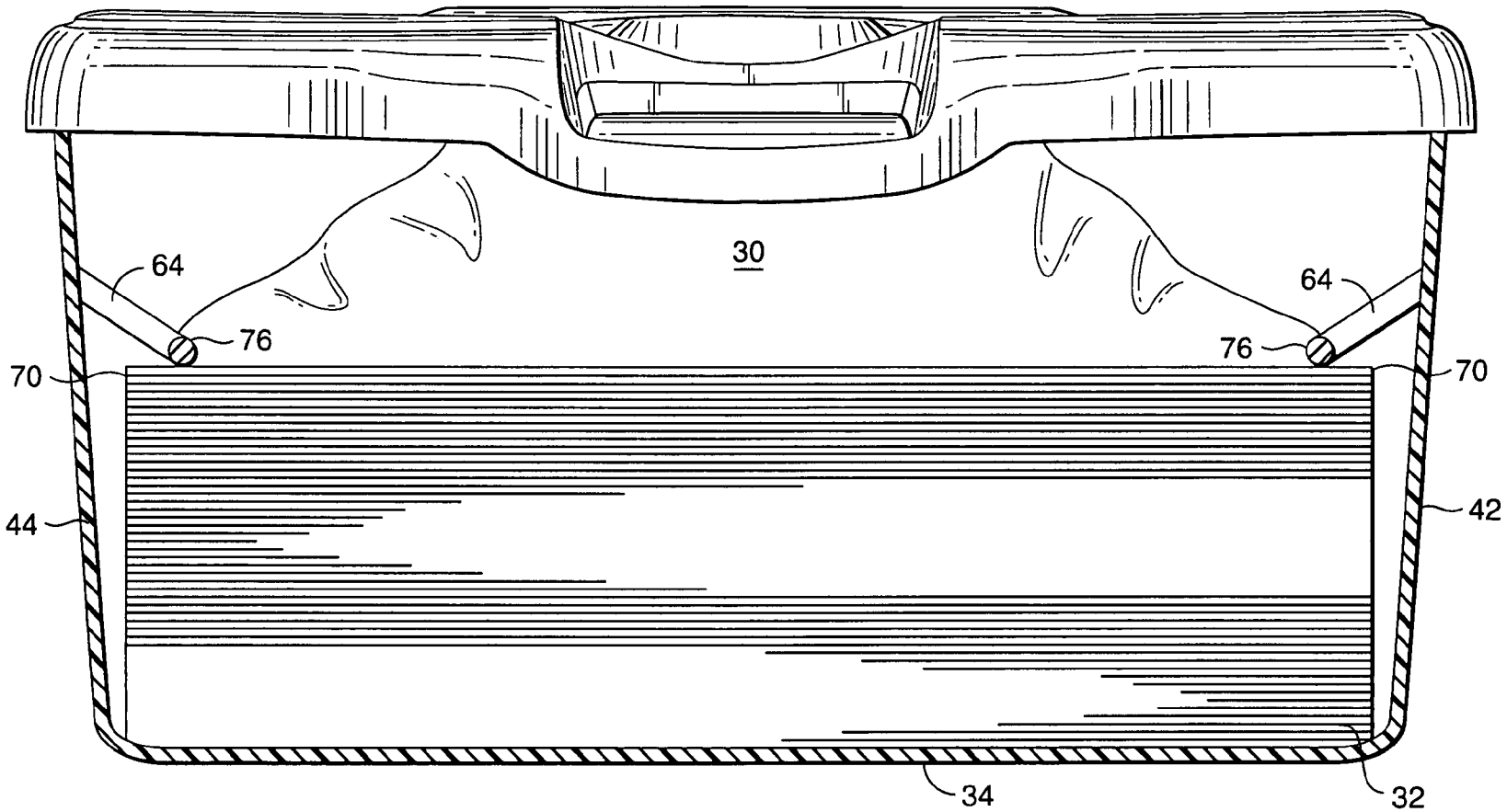
FIG. 3 is a partially cut away front view of the wet wipes dispenser of FIG. 1 taken at 3-3 just inside of the front sidewall of the lower tub.
Figure 4:
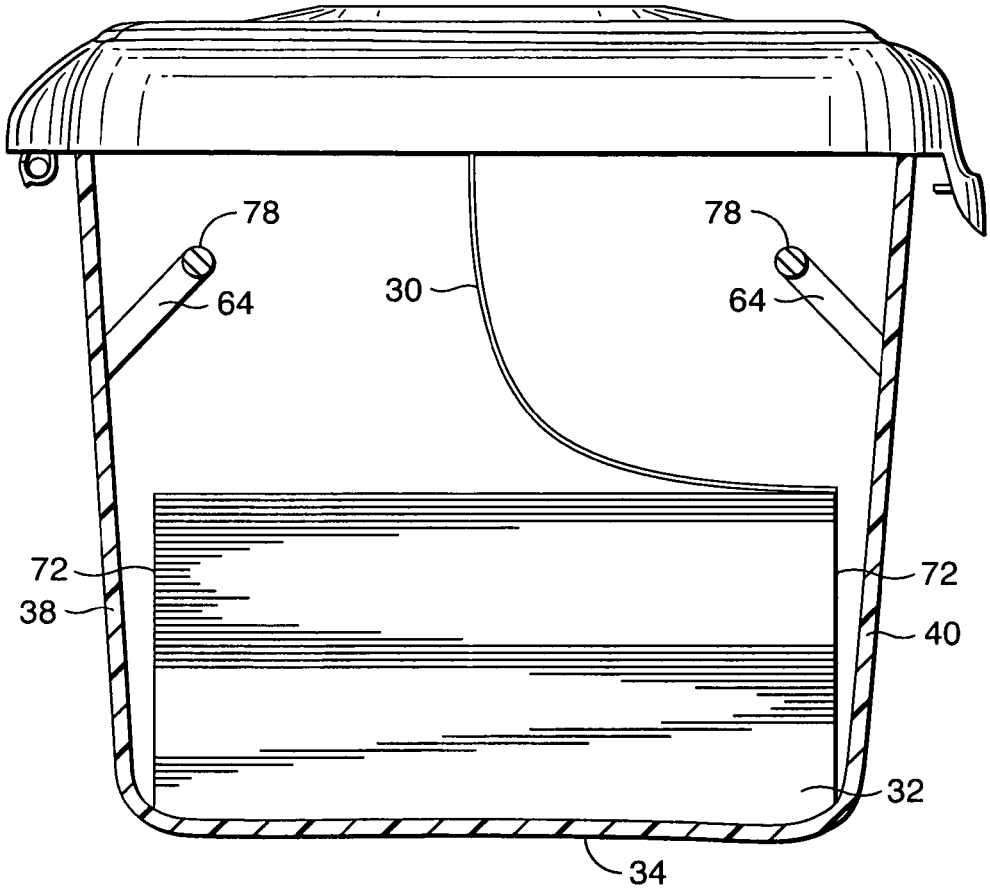
FIG. 4 is a partially cut away side view of the wet wipes dispenser of FIG. 1 taken at 4-4 just inside of the right sidewall of the lower tub.

In various embodiments of the invention, the stack contact area in touching the restraining members 64 as a percentage of the dispensing surface area 69 as determined by the formula Stack Contact Percentage=Dispensing Surface Area Contacting the Restraining Members/Total Dispensing Surface Area 100 can be between about 0.1 percent to about 30 percent, or between about 0.1 percent to about 20 percent, or between about 0.1 percent to about 10 percent, or between about 0.1 percent to about 5 percent. The inventors have determined that in some embodiments when the Stack Contact Percentage is greater than about 35 percent unreliable dispensing of the wet wipe occurred. It is desirable to reduce the Stack Contact Percentage, but too small of a contact area can result in the stack 32 falling from its elevated position as a wet wipe is dispensed, depending on the design of the restraining members 64. In one embodiment, four corner restraining members 73, as illustrated in FIGS. 3, 4, and 5, had a Stack Contact Percentage of approximately 4 percent, which provided reliable inverted dispensing of the wet wipes. In another embodiment, two restraining members 64 extending for a portion of the length of the stack 32 along both of the opposing sides 72 had a Stack Contact Percentage of approximately 15 percent, which provided reliable inverted dispensing of the wet wipes.

Another factor that has an affect on reliable inverted dispensing is the number of restraining members 64 used, their location and orientation in relation to the stack 32, and the shape or profile of the restraining members. In one embodiment, the restraining members 64 include four corner restraining members 73 with each corner restraining member spanning a corner 74 of the stack 32, as best seen in FIG. 5. The corner restraining members 73 have a first end 76 attached to either the front panel 38 or the back panel 40, and a second end 76 attached to either the right panel 42 or the left panel 44 of the tub 16, thereby forming diagonal elements spanning each corner 74 of the stack 32. The corner restraining members 73 can be made from a rod having a circular cross section as illustrated or the corner restraining members can be a plane or other surface spanning the corners 74 of the stack 32, or the corner restraining members can have another cross-sectional shape. In one embodiment, the corner restraining members can be a 0.25" diameter rod of ultra high molecular weight polyethylene (UHMWPE).

In various embodiments of the invention, the corner restraining members 73 can be angled with respect to the top 12 or a plane parallel with and intersecting the dispensing panel 29, as best seen in FIG. 6. With reference to FIG. 6 showing inverted dispensing of the wet wipes 30, the first ends 76 of the corner restraining members 73 can be located at a greater distance from a plane parallel with and intersecting the dispensing panel 29 than the second ends 78. It is believed that by elevating the first ends 76 of the corner restraining members 73 with respect to the second ends 78, improved inverted dispensing results by reducing the total area of the corner restraining members 73 in contact with the dispensing surface area 69 of the stack 32. Additionally, angling the corner restraining members 73 can promote the stack 32 to become concave in shape along a leading edge 68 between the opposing ends 70 with respect to the dispensing panel 29 or the top 12 when the wet wipes dispenser 10 is inverted. Thus, the stack 32 is concave along the longer dimension of the stack in the direction of the opposing sides 72 with respect to the top 12, the main-lid 18, and the dispensing panel 29.

In various embodiments of the invention, it is believed that by having the stack 32 assume a concave shape along the leading edge 68 with respect to the top 12, the stack is less likely to droop or sag in the middle portion disposed above the dispensing orifice 28. This helps to maintain the desired elevation distance, H, of the stack 32 when the wet wipes dispenser is inverted, thereby improving inverted dispensing of the wet wipes. It also helps to increase the capacity of the inverted wet wipes dispenser since it is more important to elevate the middle of the stack 32 an elevation distance, H, as compared to the opposing sides 70 to provide the requisite volume 66 to improve inverted dispensing since the wet wipe begins to unfurl in the middle. A convex-shaped stack would undesirably reduce the stack's elevation distance, H. It is also believed that improved inverted dispensing occurs when the stack 32 is concave, as shown, since the wet wipes 30 are peeled away from the stack 32 sooner as they are dispensed, thereby reducing the drag force during dispensing. If the stack 32 were convex along the leading edge 68 with respect to the top 12, the surface of the wipe being dispensed would have to be dragged across more of the remaining stack 32 in a shear motion, rather than being peeled away, as the wet wipe is being dispensed and pulled towards the dispensing orifice 28. Too high of a shear force or sheet-to-sheet adhesion when unfurling the wet wipe being dispensed can separate the leading wipe from the next wipe, causing a dispensing failure where the next wipe is not partially pulled through the dispensing orifice 28 as desired.

In another embodiment of the invention, the restraining members can be eliminated and the tub 16 can designed with a shorter overall length than the stack's overall length. When the stack 32 is loaded into the tub, the stack can be loaded such that it is concave along the leading edge 68 with respect to the top 12 since it is longer than the tub 16. Thus, when the wet wipes dispenser is inverted, a volume 66 is provided above the dispensing orifice 28 for the next wet wipes in the stack to transition within, and the middle of the stack is elevated with respect to the dispensing orifice 28.

Figure 8:
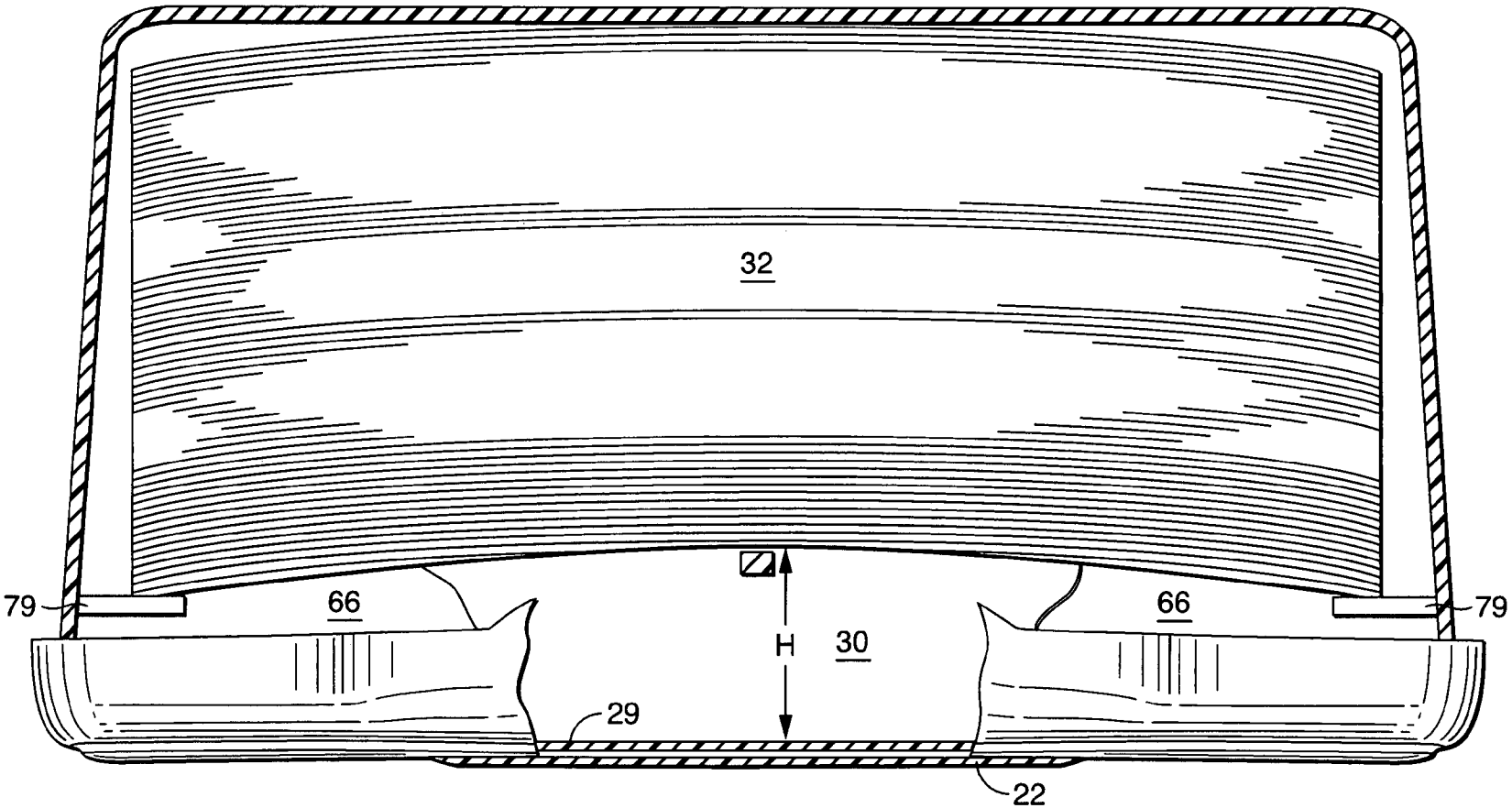
FIG. 8 is a partially cut away front view of another embodiment of a wet wipes dispenser.
Figure 9:
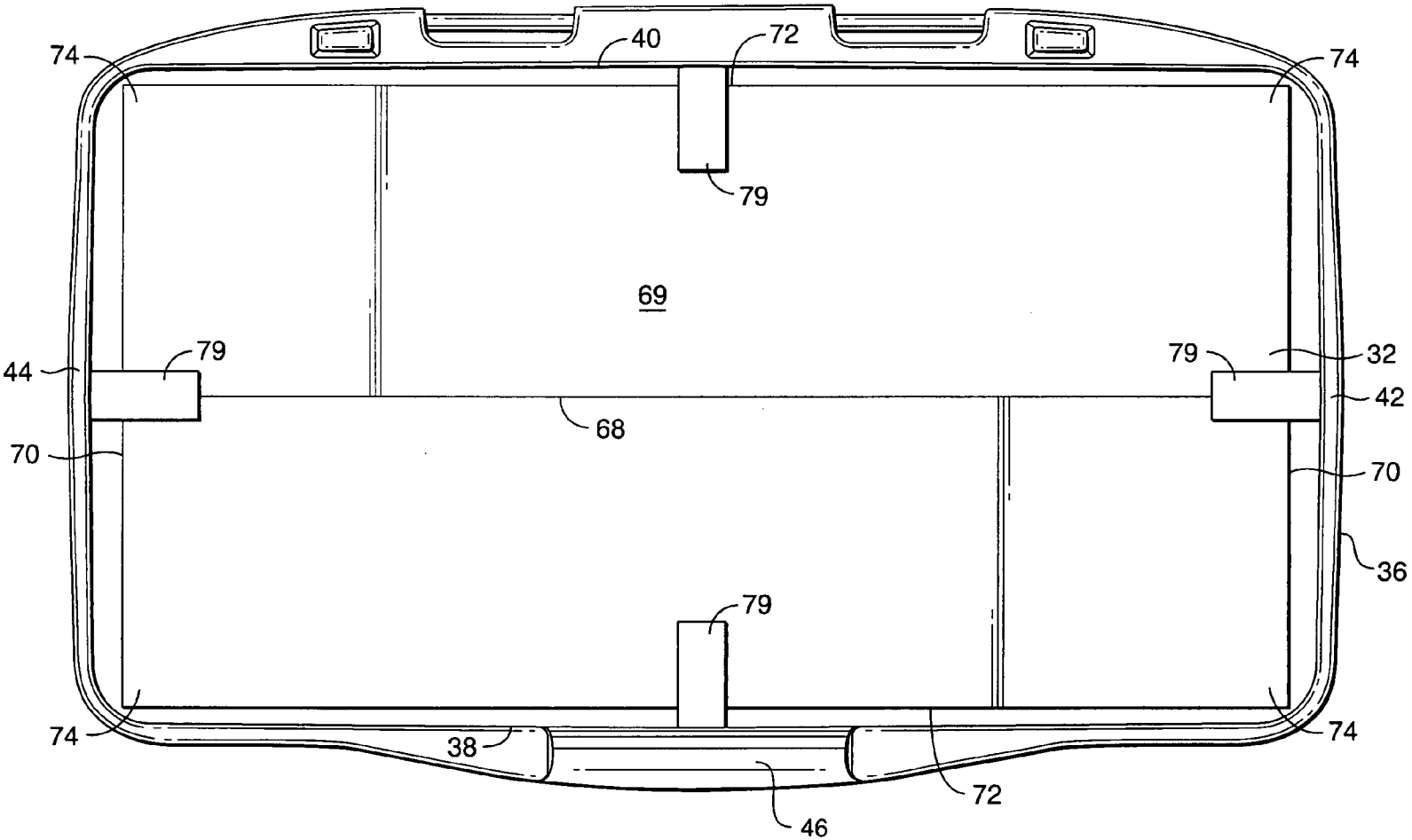
FIG. 9 is a plan view of the bottom tub of the dispenser of FIG. 8.

Referring now to FIGS. 8 and 9, another embodiment of the wet wipes dispenser is shown. In this embodiment, four midpoint restraining members 79, extending from the tub's sidewall 36, are located substantially at both midpoints of the stack's opposing sides 72 and at both midpoints of the stack's opposing ends 70. A midpoint restraining member 79 extends from the front panel 38, from the back panel 40, from the right panel 42 and from the left panel 44. The midpoint restraining members 79 extend sufficiently far, engaging the dispensing surface area 69 to hold the stack 32 in an elevated position when the wet wipes dispenser 10 is inverted. The midpoint restraining members 79 can be minimized in size to reduce the contact area with the dispensing surface area 69 for improved inverted dispensing. In this embodiment, the midpoint restraining members 79 have a rectangular cross section, but another suitable cross section can be used such as round, square, or triangular to further reduce the contact area. In various embodiments, the midpoint restraining members 79 attached to the front and back panels (38, 40) can be at a higher elevation with respect to the interior surface of the top 12, such as the dispensing panel 29 or the main-lid 18 than the midpoint restraining members 79 attached to the right and left panels (42, 44). This ensures that the stack 32 is concave along the leading edge 68 with respect to the dispensing panel 29 since the middle portion is elevated higher than the opposing ends 70. In other embodiments, the midpoint restraining members 79 can all be located at the same elevation. The difference in the elevation between the midpoint restraining members 79 attached to the front and back panels (38, 40) and the midpoint restraining members attached to the right and left panels (42, 44) can be between about 0.25 inches to about 1.0 inches.

In various embodiments of the invention, the restraining members 64 can be made of UHMWPE, polypropylene, copolymer propylene, polyethylene, or other low friction material. The restraining members 64 can be an integral fixed feature of the wet wipes dispenser 10 and molded as an integral portion of the dispenser. This would allow the restraining members 64 to be made from the same material as the wet wipes dispenser 10. For example, a shelf or a ledge protruding from the inside wall of the tub 16 can be used. Alternatively, the sidewall 36 of the tub 16 can be narrowed, recessed or reduced in dimension providing a necked region to act as a restraining member supporting the stack 32 similar in shape to that of an hourglass. The restraining members 64 can be attached to the interior of the tub's sidewall, or the restraining members can be attached to the interior of the main-lid's skirt 13 or to an interior wall 15 of the top 12. The skirt 13 or the interior wall 15 can be dimensioned as appropriate to accommodate the restraining members 64 and to provide the desired stack elevation, H, when the wet wipes dispenser 10 is inverted. By attaching the restraining members 64 to the top 12, they are automatically rotated with the main-lid 18 when it is opened, thereby making it easier to load a new stack 32 of wet wipes 30 into the tub 16. The restraining members 64 can be attached to the wet wipes dispenser 10 with a living hinge. A living hinge would allow the restraining members to be rotated into position by the user and allow for stacking or nesting of the tubs 16 with internal restraining members. Alternatively, the restraining members 64 can be separate pieces that utilize a snap fit for attachment to the wet wipes dispenser 10. For example, the restraining members 64 could be separately attachable to the tub's rim 17 or other portion of the wet wipes dispenser 10 such as the top 12. This would allow for the restraining members 64 to be made from either the same or different materials as the wet wipes dispenser 10.

In various embodiments of the invention 1, 2, 3, 4, 5, 6, or more restraining members can be used. A single midpoint restraining member 79 extending from the front or back panel (38, 49) can be used to tilt the stack 32 within the wet wipes dispenser, thereby providing a volume 66 above the dispensing orifice 28 for a wet wipe to unfurl in when the wet wipes dispenser is inverted. Two midpoint restraining members 79 extending from the front panel 38 and the back panel 40 can be used to provide the desired elevation height, H, while leaving the opposing ends 70 of the stack 32 unrestrained. Such a configuration would promote forming a concave stack when the wet wipes dispenser is inverted. To use three restraining members, two restraining members can extend from the back panel 40 and one midpoint restraining member can extend from the front panel 38. The midpoint restraining member 79 extending from the front panel 38 can be located at a higher elevation than the other two restraining members to force the stack 32 into a concave shape with respect to the top 12 if desired. Another embodiment of four restraining members is to have two restraining members extending from the back panel 40 near the quarter points of the stack 32 and two additional restraining members extending from the front panel 38 near the quarter points of the stack. Such an embodiment would leave the opposing ends 70 unrestrained, helping to promote a concave stack when the wet wipes dispenser is inverted. To use six restraining members, midpoint restraining members 79 located on the opposing ends 70 of the stack can be used in conjunction with four quarter point restraining members. Other combinations of restraining members 64 are possible. For example, four corner restraining members 73 can be used in combination with one or two midpoint restraining members 79 extending from either the front panel 38 back panel 40 or both can be used. The midpoint restraining members can be located at a higher elevation with respect to the top 12 than the corner restraining members 73 when the wet wipes dispenser is inverted to promote a concave stack 32.

Figure 10:
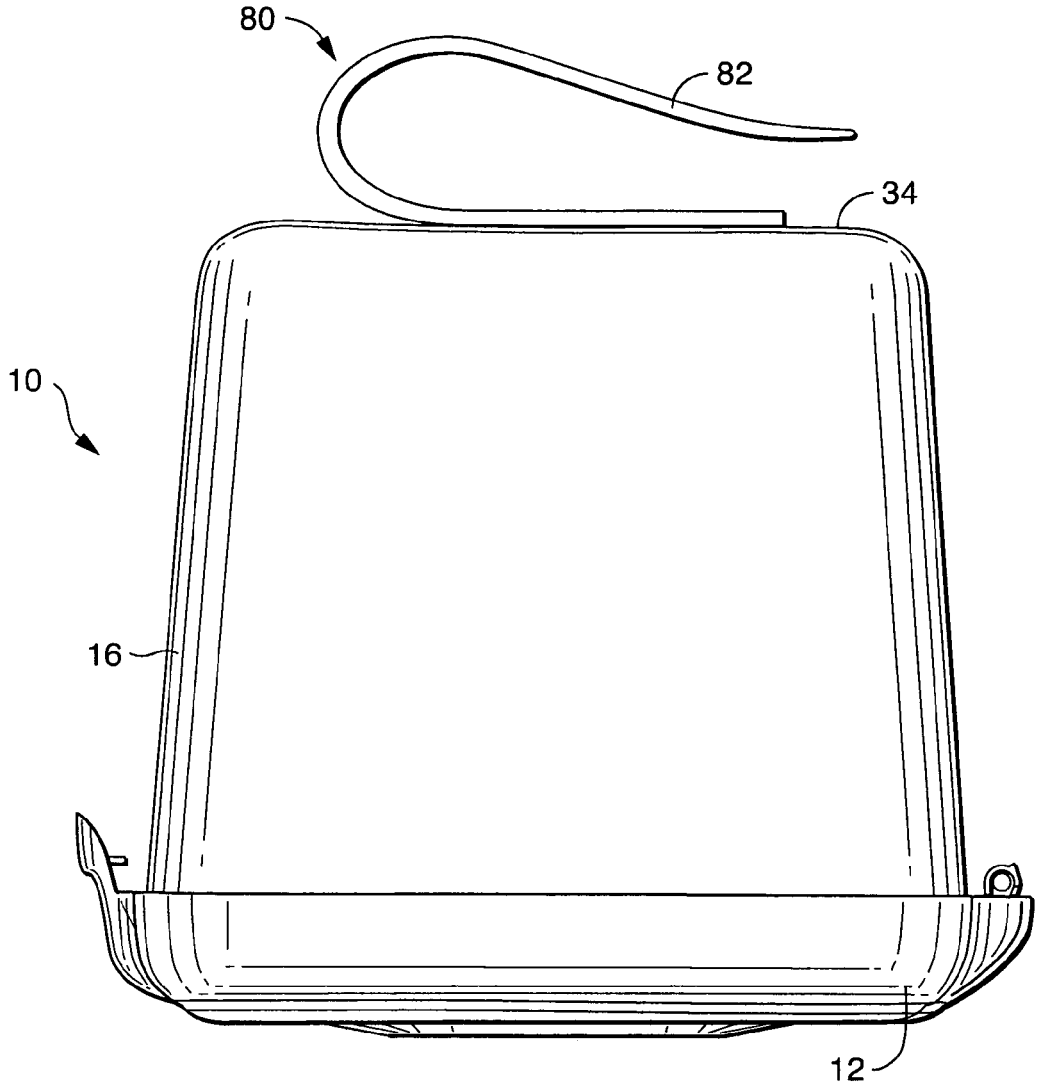
FIG. 10 is a side view of the wet wipes dispenser of FIG. 1 in an inverted position with a hanger member attached to the bottom.

Referring now to FIG. 10, a hanger member 80 is shown attached to the tub's bottom 34. The hanger member can be a spring clip 82 or two spring clips spaced along the bottom 34 and attachable to the bottom 34 for supporting the wet wipes dispenser 10 in an inverted position. A shelf edge, towel bar, or other support object can be inserted into the spring clip 82 to hold the wet wipes dispenser 10 inverted. The spring clip can be removably attached to the tub's bottom 34 to enable use of the wet wipes dispenser in an upright dispensing mode. Other types of hanger members 80 are possible. Some examples include hook and loop material, adhesive material, a magnetic material, a strap, a hook, suction cups, a mounting bracket, or a mounting plate. A double-sided spring clip can be used as a hanger member 80. One side of the clip can be smaller and attach to a shelf edge while the other side can be much larger and slip over the top and bottom of the wet wipes dispenser. In another embodiment, the wet wipes dispenser 10 can be provided with a stand for holding the dispenser in an inverted position. Alternatively, the wet wipes dispenser 10 can slide into a support or a U-shaped hanger member 80 for attachment to a shelf. A U-shaped bracket serving as a hanger member having one side of the U attached to the bottom 34 can be slid over the edge of a shelf and held with thumb screws to secure the wet wipes dispenser. Other hanger members 80 known to those of skill in the art can be utilized to permanently or removably support the wet wipes dispenser 10 in an inverted position.

Other wet wipe dispensers designed to dispense a stack of wet wipes can be modified to include at least one restraining member 64 for inverted dispensing. For example, a suitable wet wipes dispenser could have a top similar to FIG. 7 with restraining members extending from the interior wall 15. The top could be attached to flexible plastic bag material instead of a rigid plastic tub 16 to form the wet wipes dispenser 10. The wet wipes dispenser could be designed with the mini-lid 22 or dispensing lid on the top 12 of the wet wipes dispenser 10 and the main-lid 18 or refill lid on the bottom 34. Such an arrangement can make it easier to load a refill stack 32 into a wet wipes dispenser 10 having restraining members 64 located on the tub's sidewall 36. Additional wet wipes dispensers are disclosed in U.S. Pat. No. 4,971,220 entitled Container With Stay Open Lid; U.S. Pat. No. 6,269,969 entitled Wet Wipes Container With Improved Closure; U.S. Pat. No. 6,269,970 entitled Wet Wipes Container Having A Tear Resistant Lid; and in U.S. Pat. No. 6,401,968 entitled Wet Wipes Container Having An Improved Opening Mechanism. Such dispensers can be modified to include at least one restraining member 64.

Other modifications and variations to the present invention may be practiced by those of ordinary skill in the art without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A wet wipes dispenser comprising:

a top having a dispensing orifice, a bottom, and a sidewall;

at least one lid covering the dispensing orifice for access to a stack of wet wipes having a pair of opposing sides and a pair of opposing ends located inside of the wet wipes dispenser;

at least four restraining members to hold the stack of wet wipes within the wet wipes dispenser elevated at a positive distance, H, from the dispensing orifice when the wet wipes dispenser is inverted, wherein at least a portion of both the width and the length of the stack of wet wipes are not contacted by a restraining member; and wherein the at least four restraining members each comprise a midpoint restraining member that extends from the sidewall at a location approximately coincident with the midpoint of the stack alone each of the pair opposing sides and along each of the pair opposing ends.

2. The wet wipes dispenser of claim 1 wherein the stack has a leading edge and the at least one restraining member holds the stack in a concave shape along the leading edge with respect to the top having the dispensing orifice when the wet wipes dispenser is inverted.

3. The wet wipes dispenser of claim 2 wherein the distance, H, of the elevated stack when the wet wipes dispenser is inverted is between about 0.5 to about 2 inches.

4. The wet wipes dispenser of claim 2 comprising a Stack Contact Percentage of the at least one restraining member with a dispensing surface area of the stack, and the Stack Contact Percent is between about 0.1 percent to about 30 percent.

5. The wet wipes dispenser of claim 1 comprising a Stack Contact Percentage of the at least one restraining member with a dispensing surface area of the stack, and the Stack Contact Percent is between about 0.1 percent to about 30 percent.

6. The wet wipes dispenser of claim 1 wherein the sidewall and the bottom form a tub having a front panel, a back panel, a right panel and a left panel; the front panel and back panel being longer than the right panel and left panel such that the tub appears rectangular when viewed from the top; and the midpoint restraining members extending from the front and back panels located at a greater distance from the top when the dispenser is inverted than the midpoint restraining members extending from the right and left panels.

7. The wet wipes dispenser of claim 6 wherein the distance, H, of the elevated stack when the wet wipes dispenser is inverted is between about 0.5 to about 2 inches.

8. The wet wipes dispenser of claim 1 wherein the top comprises a main-lid having a skirt and a mini-lid for access to the dispensing opening, the mini-lid hinged to the main-lid; and the main-lid is hinged to a tub comprising the sidewall and the bottom.

9. The wet wipes dispenser of claim 8 comprising a Stack Contact Percentage of the at least one restraining member with a dispensing surface area of the stack, and the Stack Contact Percent is between about 0.1 percent to about 30 percent.

10. The wet wipes dispenser of claim 1 wherein the distance, H, of the elevated stack when the wet wipes dispenser is inverted is between about 0.5 to about 2 inches.

11. The wet wipes dispenser of claim 1 comprising a hanger member attached to the wet wipes dispenser for supporting the wet wipes dispenser in an inverted position.

12. A wet wipes dispenser comprising:

a top having a dispensing orifice, a bottom, and a sidewall;

at least one lid covering the dispensing orifice for access to a stack of wet wipes having a pair of opposing sides and a pair of opposing ends located inside of the wet wipes dispenser; and at least four restraining members to hold the stack of wet wipes within the wet wipes dispenser elevated at a positive distance, H, from the dispensing orifice when the wet wipes dispenser is inverted, the at least four restraining members each comprise a corner restraining member that spans across a corner of the stack of wet wipes where the opposing sides intersect the opposing ends.

13. The wet wipes dispenser of claim 12 wherein the stack has a leading edge and the corner restraining members hold the stack in a concave shape along the leading edge with respect to the top having the dispensing orifice when the wet wipes dispenser is inverted.

14. The wet wipes dispenser of claim 12 wherein the sidewall and the bottom form a tub having a front panel, a back panel, a right panel and a left panel; the corner restraining members each have a first end attached to either the front panel or the back panel, and a second end attached to either the right panel or the left panel; and the first ends are located at a greater distance from the top than the second ends when the wet wipes dispenser is inverted.

15. The wet wipes dispenser of claim 12 wherein the distance, H, of the elevated stack when the wet wipes dispenser is inverted between about 0.5 to about 2 inches.

16. The wet wipes dispenser of claim 12 comprising a Stack Contact Percentage of the at least one restraining member with a dispensing surface area of the stack, and the Stack Contact Percent is between about 0.1 percent to about 30 percent.

* * * * *